US005186114A

United States Patent [19]

Ikawa

[11] Patent Number: 5,186,114

[45] Date of Patent: Feb. 16, 1993

[54] THREAD TENSION ADJUSTING APPARATUS FOR A SEWING MACHINE

[75] Inventor: Naoya Ikawa, Hyogo, Japan

[73] Assignee: Pegasus Sewing Machine Mfg. Co., Ltd., Osaka, Japan

[21] Appl. No.: 686,518

[22] Filed: Apr. 17, 1991

[30] Foreign Application Priority Data

Apr. 20, 1990 [JP] Japan ..... 2-105660

[51] Int. Cl.[5] ..... D05B 47/00

[52] U.S. Cl. ..... 112/254; 242/149; 310/314

[58] Field of Search ..... 112/254, 255, 302; 242/149, 147 M; 310/314

[56] References Cited

U.S. PATENT DOCUMENTS 4,984,749 1/1991 Matsui et al. ..... 242/35.5
5,033,400 7/1991 Fischer ..... 112/254
5,056,734 10/1991 Uchida et al. ..... 242/147 R

FOREIGN PATENT DOCUMENTS 61-180683 11/1986 Japan .
1-192391 8/1989 Japan .

*Primary Examiner*—Andrew M. Falik
*Assistant Examiner*—Paul C. Lewis
*Attorney, Agent, or Firm*—Wegner, Cantor, Mueller & Player

[57] ABSTRACT

A thread tension adjusting apparatus, used in a sewing machine, adjusts tension of a supplied thread by adjusting a thread holding force. The apparatus is provided on a thread supply path running from a thread source to a thread processing section such as a needle and a looper. The thread tension adjusting apparatus comprises a pair of members respectively having portions opposed to each other. At least one of the members is a piezoelectric actuator for changing a distance between the portions when being driven, whereby to adjust a thread holding force.

6 Claims, 3 Drawing Sheets

THREAD TENSION ADJUSTING APPARATUS FOR A SEWING MACHINE

BACKGROUND OF THE INVENTION (1) Field of the Invention

This invention relates to a thread tension adjusting apparatus, used in a sewing machine, for adjusting tension of a supplied thread by adjusting a thread holding force, the apparatus being provided on a thread supply path running from a thread source to a thread processing section such as a needle and a looper, especially to a thread tension adjusting apparatus for adjusting thread tension using a piezoelectric actuator.

(2) Description of the Prior Art

Thread tension adjustment for a sewing machine is done in two ways: 1) by continuously applying tension to the thread and 2) by applying tension to the thread for a specified period for each stitch. In the latter case, the thread tension should be changed at a high speed, which requires a thread tension adjusting apparatus having a high-speed responsibility.

For obtaining such a high-speed responsibility, a thread tension adjusting apparatus equipped with a piezoelectric actuator has been developed as disclosed in Japanese Utility Model Publication Kokai No. 61-180683 and Japanese Patent Publication Kokai No. 1-192391.

In such an apparatus, although the actuator possesses a high-speed responsibility, a thread holding member cannot hold the thread at a desirable timing for each stitch due to the inertia force caused by the weight of the member itself.

SUMMARY OF THE INVENTION

Accordingly, this invention has an object of offering a thread tension adjusting apparatus which has an extremely small inertia force and an excellent highspeed responsibility.

The above object is fulfilled by a thread tension adjusting apparatus, used in a sewing machine, for adjusting tension of a supplied thread by adjusting a thread holding force, the apparatus being provided on a thread supply path running from a thread source to a thread processing section such as a needle and a looper, the thread tension adjusting apparatus comprising a pair of members respectively having portions opposed to each other, at least one of the members is a piezoelectric actuator for changing a distance between the portions when being driven, whereby to adjust a thread holding force.

The portions each may have a thread touching piece fixed thereon.

The distance between the portions may be substantially the same as a diameter of a thread when the piezoelectric actuator is not driven.

The piezoelectric actuator may be a piezoelectric plate which can be bent.

The piezoelectric actuator may be a laminated piezoelectric element which is expandable in a thickness direction thereof.

According to the above construction, at least one of a pair of members having portions interposing a thread is a piezoelectric actuator. Since the movement of the actuator directly acts on the thread, a thread tension adjusting apparatus having a small inertia force and a high-speed responsibility can be obtained.

If a distance between the above pair of members is substantially the same as a diameter of the thread when the actuator is not driven, there is no extra force acting on the thread. Therefore, a desirable amount of thread can be supplied.

The above object is also fulfilled by a thread tension adjusting apparatus provided on a thread supply path running from a thread source to a thread processing section such as a needle and a looper, the thread tension adjusting apparatus comprising a first piezoelectric actuator provided at a side of a thread; a second piezoelectric actuator provided symmetrically to the first piezoelectric actuator with the thread interposed therebetween; wherein the first and second piezoelectric actuators are controlled to bend in opposite directions to each other, whereby narrowing a distance between tips of bent portions of the actuators to a length which is shorter than a diameter of the thread.

A longitudinal direction of the first and second piezoelectric actuators may be in parallel with a thread supply direction.

The first and second piezoelectric actuators may have thread touching pieces fixed thereon, respectively.

The thread touching pieces may be formed of a material having a small friction coefficient against the thread.

A distance between the thread touching pieces may be substantially the same as a diameter of the thread when the first and second actuators are not driven.

The above thread tension adjusting apparatus may further comprise a control device for driving and then stopping driving the first and second piezoelectric actuators each time a sewing machine is driven.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings.

DESCRIPTION OF THE PREFERRED EMBODIMENTS

Figure 1:
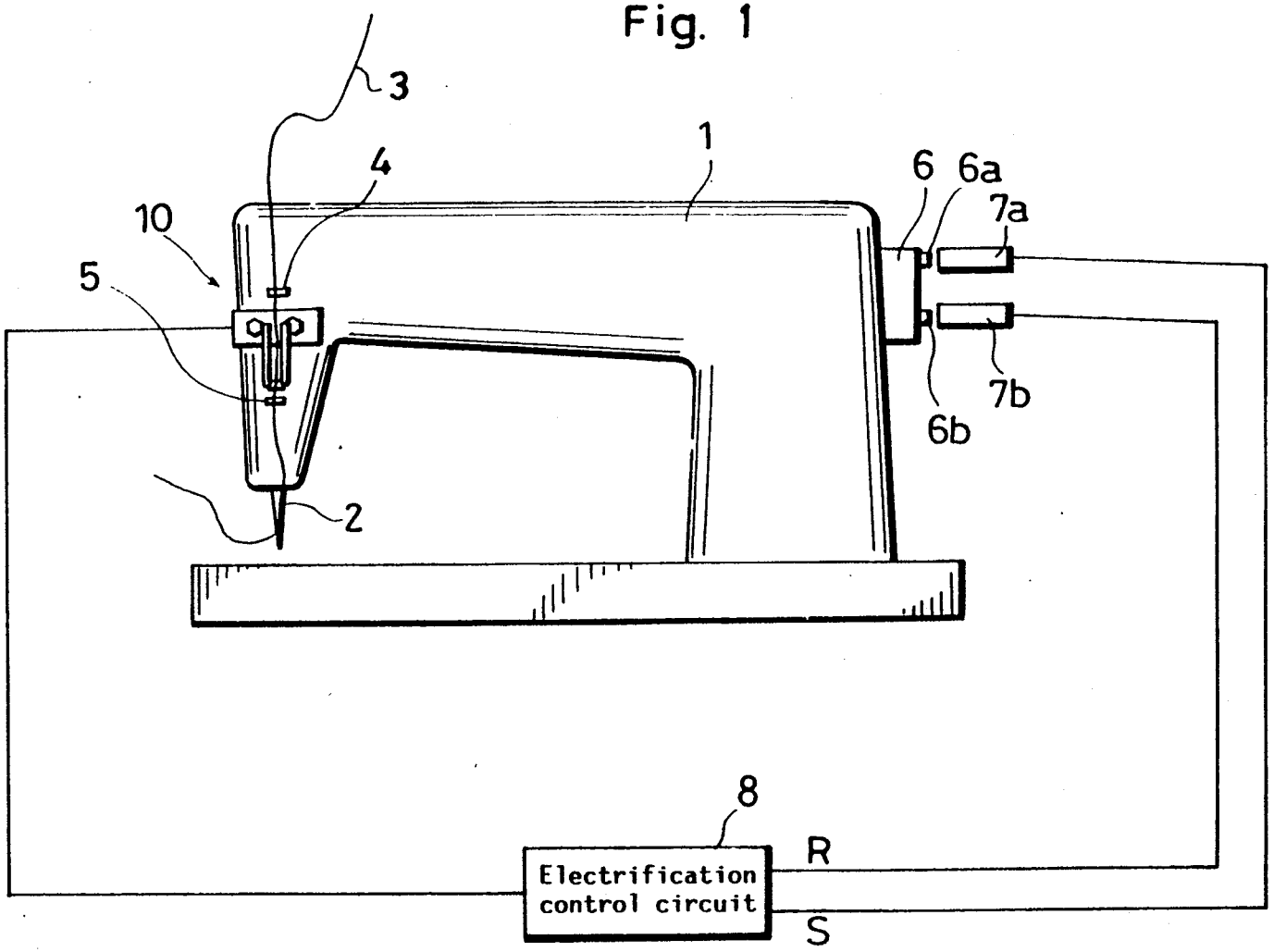
FIG. 1 is a front view of a sewing machine equipped with a thread tension adjusting apparatus as a first embodiment according to this invention.

A first embodiment of this invention will be described referring to FIGS. 1 through 5.

The sewing machine 1 comprises a needle 2 as a thread processing section, the needle making one vertical reciprocation while a main shaft (not shown) is rotated once. A needle thread 3 supplied from a thread source (not shown) is to be carried to the needle 2 after the tension of the thread 3 is adjusted by the thread tension adjusting apparatus 10. The sewing machine 1 further comprises thread guides 4 and 5 for guiding the thread 3 along a specified thread path and a hand wheel 6. The hand wheel 6 has iron strips **6*a* and 6*b*** attached thereon at different distances from a central axis thereof and is rotated at the same speed as the main shaft.

Figure 2:
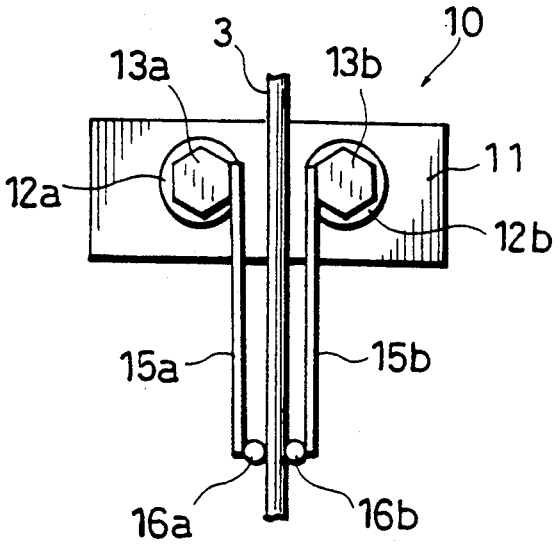
FIG. 2 is a front view of the thread tension adjusting apparatus.
Figure 3:
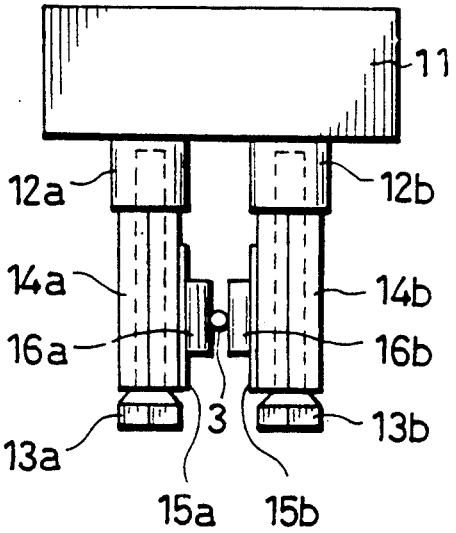
FIG. 3 is a plan view of the apparatus.

As shown in FIGS. 2 and 3, the thread tension adjusting apparatus 10 comprises an attachment plate 11; bases 12*a* and 12*b* fixed to the attachment plate 11; and bolts 13*a* and 13*b*, tips of which are respectively inserted into holes of the bases 12*a* and 12*b*; and hexagonal pillars 14*a* and 14*b* respectively encasing the bolts 13*a* and 13*b*. The apparatus 10 further comprises piezoelectric actuators 15*a* and 15*b* which are fixed on the hexagonal pillars 14*a* and 14*b* at first ends thereof, respectively; and rod-shaped thread touching pieces 16*a* and 16*b* (each having, for instance, a diameter of 2 mm and a length of 5.5 mm) attached to second ends of the piezoelectric actuators 15*a* and 15*b*. The thread touching pieces 16*a* and 16*b* are formed of iron or ceramics processed to have a low friction coefficient. The thread 3 which is guided by the thread guides 4 and 5 is to pass between central portions of the thread touching pieces 16*a* and 16*b*, the central portions being in a longitudinal direction thereof.

Since the tips of the bolts 13*a* and 13*b* are inserted through the bases 12*a* and 12*b*, the hexagonal pillar 14*a* is fixed between the bolt 13*a* and the base 12*a*, and the hexagonal pillar 14*b* is fixed between the bolt 13*b* and the base 12*b*. The distance between the thread touching pieces 16*a* and 16*b* can be changed in accordance with the diameter of the thread 3 by releasing the bolts 13*a* and 13*b*, rotating the hexagonal pillars 14*a* and 14*b* and then tightening the bolts 13*a* and 13*b*.

Figure 4:
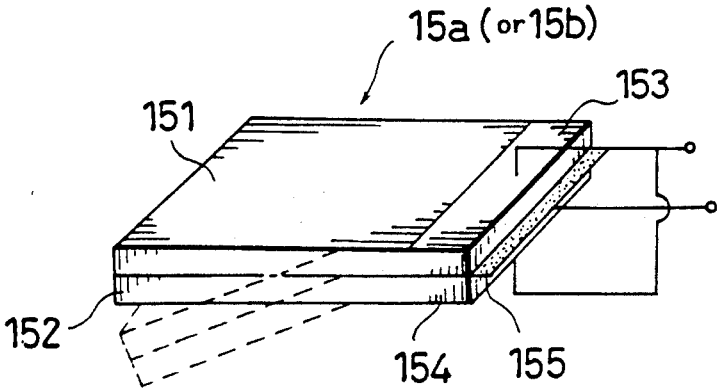
FIG. 4 is a perspective view of a piezoelectric actuator provided in the apparatus.

As shown in FIG. 4, the piezoelectric actuators 15*a* and 15*b* each comprise a bimorph-type piezoelectric plates 151 and 152. The piezoelectric actuators 15*a* and 15*b* are each bent in the bending mode when a specified voltage is applied to electrodes 153, 154 and 155 provided at the first ends of the actuators 15*a* and 15*b*. The actuators 15*a* and 15*b* are arranged to be bent in opposite directions with bending tips thereof being opposed to each other. By such an arrangement, a distance between the thread touching pieces 16*a* and 16*b* can be changed. It is desirable that the above distance is substantially the same as a diameter of the thread 3 when the actuators 15*a* and 15*b* are not driven, whereby applying no tension to the thread 3.

The actuators 15*a* and 15*b* are driven in the following way.

The iron strips 6*a* and 6*b* are detected as the hand wheel 6 is rotated once, namely, stitch by stitch, by whirl current system displacement gauges 7*a* and 7*b* provided in the vicinity of the hand wheel 6. The detection results are sent to a driving control circuit 8 as a set signal S and a reset signal R. The circuit 8 outputs a signal, whereby to drive the actuators 15*a* and 15*b*. Used as the circuit 8 is, for instance, a circuit comprising an R-S flip-flop and an amplifier for amplifying a signal outputted from the R-S flip-flop. Instead of the displacement gauges 7*a* and 7*b*, some other system of detectors such as optical sensors can be used.

Based on the signal from the circuit 8, the actuators 15*a* and 15*b* are bent, whereby the actuators 15*a* and 15*b* get closer. Thus, the thread 3 in contact with the pieces 16*a* and 16*b* are held strongly. When the signal input from the circuit 8 stops, the actuators 15*a* and 15*b* go back to original positions thereof.

Figure 5:
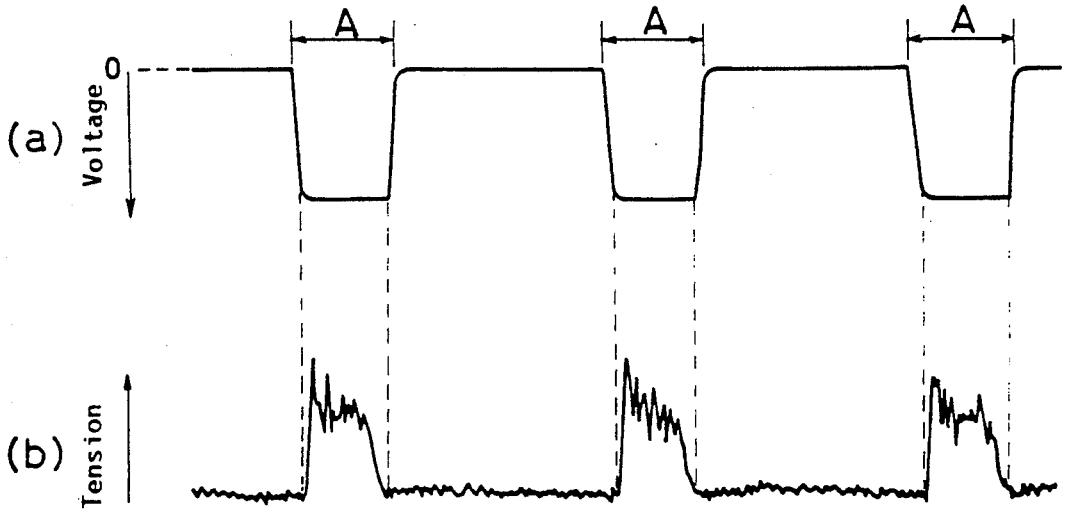
FIG. 5 is a chart showing the signal output from a driving control circuit 8 and the fluctuation of the thread tension.

In FIG. 5, (a) shows the signal output from the circuit 8, and (b) shows the fluctuation of the thread tension. As apparent from FIG. 5, the thread tension is fluctuated in synchronization with the signal output from the circuit 8 owing to the thread tension adjusting apparatus 10.

Figure 6:
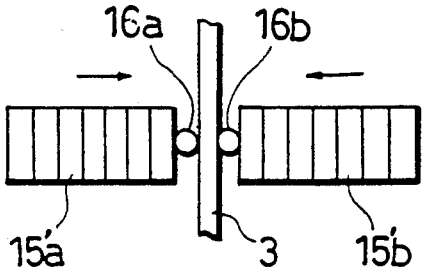
FIG. 6 is a schematic view of a second embodiment of this invention.

FIG. 6 is a schematic view of a second embodiment according to this invention.

In this embodiment, the thread 3 is interposed between piezoelectric actuators 15'*a* and 15'*b* comprising laminated piezoelectric elements expandable in thickness directions thereof (in directions of the arrows), instead of the piezoelectric actuators 15*a* and 15*b*. In such a construction, the thread 3 is held strongly when the actuators 15'*a* and 15'*b* are expanded, and is released when the actuators 15'*a* and 15'*b* are contracted. The same effects are offered as the first embodiment.

The two piezoelectric actuators used in the above two embodiments may be replaced with one piezoelectric actuator and a thread pressing member with no bending or expanding.

The lower the friction coefficient of the pieces 16*a* and 16*b* is, the less the friction is between the thread and the pieces 16*a* and 16*b*. The less friction means the more stable thread tension. If the two actuators or an actuator and a thread pressing member are processed to be resistant against friction, the pieces 16*a* and 16*b* can be eliminated.

The present invention, which is applied to adjust the tension of the needle thread in the above embodiments, can also be applied for a looper or other thread processing sections.

Although the present invention has been fully described by way of embodiments with references to the accompanying drawings, it is to be noted that various changes and modifications will be apparent to those skilled in the art. Therefore, unless such changes and modifications depart from the scope of the present invention, they should be construed as being included therein.

What is claimed is:

1. A thread tension adjusting apparatus provided on a thread supply path running from a thread source to a thread processing section such as a needle and a looper, said thread tension adjusting apparatus comprising:

a first piezoelectric actuator provided at a side of a thread;

a second piezoelectric actuator provided symmetrically to said first piezoelectric actuator with the thread interposed therebetween;

wherein said first and second piezoelectric actuators are controlled to bend in opposite directions to each other, whereby narrowing a distance between tips of bent portions of said actuators to a length which is shorter than a diameter of the thread.

2. An apparatus of claim 1, wherein a longitudinal direction of said first and second piezoelectric actuators is in parallel with a thread supply direction.

3. An apparatus of claim 1, wherein said first and second piezoelectric actuators have thread touching pieces fixed thereon, respectively.

4. An apparatus of claim 2, wherein the thread touching pieces are formed of a material having a small friction coefficient against the thread.

5. An apparatus of claim 3, wherein a distance between the thread touching pieces is substantially the same as a diameter of the thread when said first and second actuators are not driven.

6. An apparatus of claim 1, further comprising control means for driving and then stopping driving said first and second piezoelectric actuators each time a sewing machine is driven.

* * * * *